US010202555B2

(12) United States Patent
Sukruangsap

(10) Patent No.: US 10,202,555 B2
(45) Date of Patent: Feb. 12, 2019

(54) GASIFICATION STOVE

(71) Applicant: Apichat Sukruangsap, Samutprakan (TH)

(72) Inventor: Apichat Sukruangsap, Samutprakan (TH)

( * ) Notice: Subject to any disclaimer, the term of this patent is extended or adjusted under 35 U.S.C. 154(b) by 76 days.

(21) Appl. No.: 15/629,157

(22) Filed: Jun. 21, 2017

(65) Prior Publication Data

US 2018/0179459 A1 Jun. 28, 2018

Related U.S. Application Data

(60) Provisional application No. 62/438,879, filed on Dec. 23, 2016.

(51) Int. Cl.
*C10J 3/24* (2006.01)
*C10J 3/36* (2006.01)

(52) U.S. Cl.
CPC . *C10J 3/24* (2013.01); *C10J 3/36* (2013.01); *C10J 2200/09* (2013.01); *C10J 2200/15* (2013.01); *C10J 2300/0916* (2013.01)

(58) Field of Classification Search
CPC ..... F27B 17/0083; F27B 5/13; F27B 5/19; F27B 3/19; F27B 1/21; F24C 15/001; F24C 15/002; F24C 15/32
See application file for complete search history.

(56) References Cited

U.S. PATENT DOCUMENTS 1,465,043 A * 8/1923 Ivor ..... F24C 15/001 126/299 R
3,253,906 A * 5/1966 Campbell ..... C10J 3/08 266/171
4,180,052 A * 12/1979 Henderson ..... F24B 1/18 110/297
4,546,553 A * 10/1985 Best ..... F26B 21/00 118/642
8,227,728 B2 * 7/2012 Best ..... A47J 37/0635 219/411
2017/0347832 A1 * 12/2017 Lin ..... A47J 33/00

* cited by examiner

*Primary Examiner* — Matthew J Merkling
(74) *Attorney, Agent, or Firm* — Muncy, Geissler, Olds & Lowe, P.C.

(57) ABSTRACT

A gasification stove includes an upper housing including an upper hollow body and a dome section, and a lower housing including a lower hollow body that form a stove chamber when connected to each other. A separator for collecting a gas and flame generated from burning of the biomass is arranged in the stove chamber and includes a bowl section and a chimney section. The bowl section has a first set of holes, and an upper part of the chimney section has a second set of holes. The upper part of the chimney section is air-tightly attached to an edge of a chimney opening of the upper housing. At least some of the gas flows through the first set of holes and the second set of holes to enter into the chimney section so as to react with the flame or hot air in the chimney section to generate additional flame power.

13 Claims, 9 Drawing Sheets

GASIFICATION STOVE

CROSS REFERENCE TO RELATED APPLICATIONS

This application claims priority of U.S. Provisional Application No. 62/438,879 filed on Dec. 23, 2016 under 35 U.S.C. § 119(e), the entire contents of which are hereby incorporated by reference.

BACKGROUND

Technical Field

The present disclosure relates to a gasification stove. In particular, the present disclosure relates to a gasification stove that increases fire power by utilizing gas generated from biomass.

Description of Related Art

Various designs exist for biomass stoves that combust biomass to generate heat and fire. Such biomass stoves are used as heaters and cooking stoves. However, because the conventional biomass stoves simply combust the biomass inside the biomass stove, fire power of the conventional biomass stove is too weak and/or inefficient for heating and cooking. Also this type of stove generates gas that is environmentally harmful.

There are also double-wall biomass stoves that have a first chamber within an inner wall, a second chamber between the inner wall and the outer wall and openings provided on the upper end of the inner wall. During the operation, oxygen is taken in from the bottom of stove and flows from the bottom of the biomass stove, through the second chamber and to first chamber through the openings. The air flow causes secondary combustion that promotes additional flame by supplying the oxygen. However, this type of biomass stoves still fails to maximize efficiency of the biomass stove since it requires a relatively large amount of biomass to generate sufficient fire power and does not utilize the flammable gas generated from the biomass.

SUMMARY

To address the above-discussed improvement, it is an object of the present application to provide a gasification stove that can maximize amount of energy potential of biomass by fully utilizing the gas byproduct from its combustion process and at the same time minimize the amount of environmentally harmful gas released to atmosphere.

According to the present disclosure, a gasification stove for burning biomass, includes an upper housing including an upper hollow body with a first opening and a dome section having a chimney opening, a lower housing including a lower hollow body with a closed bottom and a second opening that is connectable to the first opening of the upper hollow body, the upper housing and the lower housing forming a stove chamber when connected to each other, a separator for collecting a gas and flame generated from burning of the biomass, the separator being arranged in the stove chamber and including a bowl section and a chimney section, the bowl section having a first set of holes formed in an upper part thereof, a lower edge of the bowl section having a diameter approximately equal to a diameter of the stove chamber, a lower part of the chimney section being connected to the upper part of the bowl section, an upper part of the chimney section having a second set of holes, the upper part of the chimney section being air-tightly attached to an edge of the chimney opening of the upper housing. At least some of the gas flows through the first set of holes and the second set of holes to enter into the chimney section at the upper part of the chimney section so as to react with the flame or hot air in the chimney section to generate additional flame power.

BRIEF DESCRIPTION OF THE DRAWINGS

The accompanying drawings are presented to aid in the description of embodiments of the invention and are provided solely for illustration of the embodiments and not limitation thereof.

DETAILED DESCRIPTION

Figure 1:
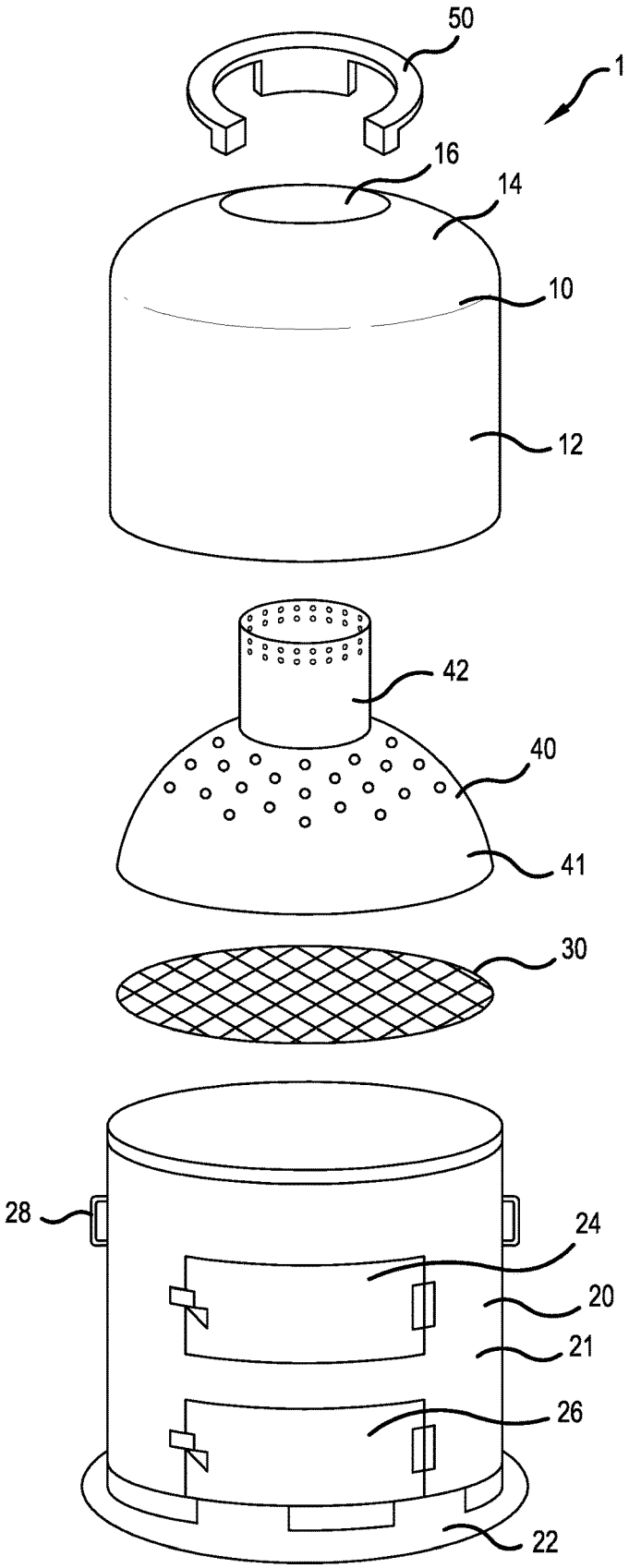
FIG. 1 is an exploded view of a gasification stove according to an embodiment of the present application.

It is understood that the following disclosure provides many different embodiments, or examples, for implementing different features of the disclosure. Specific examples of components and arrangements are described below to simplify the present disclosure. These are, of course, merely examples and are not intended to be limiting.

Referring generally to FIGS. 1-4, a gasification stove 1 includes a housing formed by an upper housing 10 and a lower housing 20. The upper housing 10 and the lower housing 20 may be made of the same material that withstands high heat, such as steel, and are configured to engage with each other to form the housing. For engagement, a stepped edge may be formed on one or both of the upper housing 10 and the lower housing 20.

The upper housing 10 and the lower housing 20 of the gasification stove 1 may be made by cutting a used propane gas tank, for example, in half. Alternatively, the upper housing 10 and the lower housing 20 may be separately formed by known means.

The upper housing 10 has a hollow cylindrical body 12, a rounded upper end 14 and an open lower end. The rounded upper end 14 may have a dome shape with contour inner and outer surfaces. An opening 16, through which an upper end 44 of the chimney 42 (discussed later) is inserted and attached, is provided on the rounded upper end. The upper housing 10 may be about approximately 9.5 inches tall and approximately 13 inches wide, and a wall thickness of the cylindrical body 12 and the upper end 14 may be approximately 0.25 inches.

The lower housing 20 has a hollow cylindrical body 21 with an open upper end, which engages with the lower end of the upper housing 10, and a closed lower end. On the lower end of the lower housing 20, a base 22 is provided to allow stable placement of the gasification stove 1 on the ground. Similar to the upper housing, the lower housing 20 may be about approximately 11.5 inches tall and approximately 13.25 inches wide, and a wall thickness of the cylindrical body 21 and the lower end may be approximately 0.25 inches.

The height and/or the shape of the base 22 may be arbitrarily selected in order to increase stability of the biomass 1 during use. On the cylindrical body 21 of the lower housing 20, a first door 24 and a second door 26 are provided. The first door 24 may have a size of 7.5 inches×4 inches and is for allowing the user to place a biomass on a mesh 30 installed therein, and the second door 26 may have a size of 7.5 inches×2 inches and is for removing ash accumulated inside the lower housing 21 and for controlling a flow of oxygen into the lower housing 20. The number and size of the first door 24 and the second door 24 may be selected as needed to provide the amount of oxygen needed to start and maintain the burning of the biomass and/or the size of the biomass. The first door 24 and the second door 26 may be attached to the lower housing 20 by hinges so that the first door 24 and the second door 26 pivotally open and close. Alternatively, slide rails may be provided on the outer surface of the cylindrical body 21 so that the first door 24 and the second door 26 may slide along the outer surface of the cylindrical body 21 in its circumferential direction to allow the first door 24 and the second door 26 to slidably open and close. Door locks may be provided on the first door 24 and/or the second door 26 to keep them closed. Windows may also be provided on the first door 24 and/or the second door 26 to allow the user to view inside the gasification stove 1.

In the lower housing 20, the mesh 30 is installed between the first door 24 and the second door 26 for placing biomass. The mesh 30 may have a diameter of approximately 12 inches and may be formed by a number of rods welded or fixed on a rim along a single direction or sets of rods welded or fixed on the rim along multiple directions. Openings of the mesh 30 formed by the rods may be small enough to prevent the biomass from falling but large enough to allow ash to fall through. The mesh may be made of iron that withstands high heat, such as steel.

A separator 40 is arranged in either the upper housing 10 or the lower housing 20, or between the upper housing 10 and the lower housing 20 at a predetermined height from the mesh 30, such as about 5.5 inches. The separator 40 may be fixedly attached to the upper housing 10 or the lower housing 20 fixedly or by a fattener or the like. The separator 40 is formed from a semispherical bowl section 41 and a chimney section 42. The bowl section 41 has a dome shape with contour inner and outer surfaces. The dome height may be approximately 5 inches. An outer diameter of a lower end of the bowl section 41 is about the same as an inner diameter of the cylindrical body 12 of the upper housing 12 and/or the cylindrical body 21 of the lower housing 20 in order to collect the heat and gas generated by the biomass during combustion. The height of the chimney section 42 from the upper end of the bowl section 41 may be about 5 inches. An upper end 44 (see FIG. 2) of the chimney section 42 is securely fixed to the opening 16 of the upper body 10 to prevent the gas generated by the biomass and flown through the openings on the separator 40 from escaping. Such secure fixation may be achieved by welding, heat-resistant adhesive, fastener, and the like.

On the upper end of the upper housing 10, an optional grill 50 may be attached around the opening 16 for placing a cooking ware, such as a pot, if the gasification stove 10 is used as a cooking stove.

Figure 2:
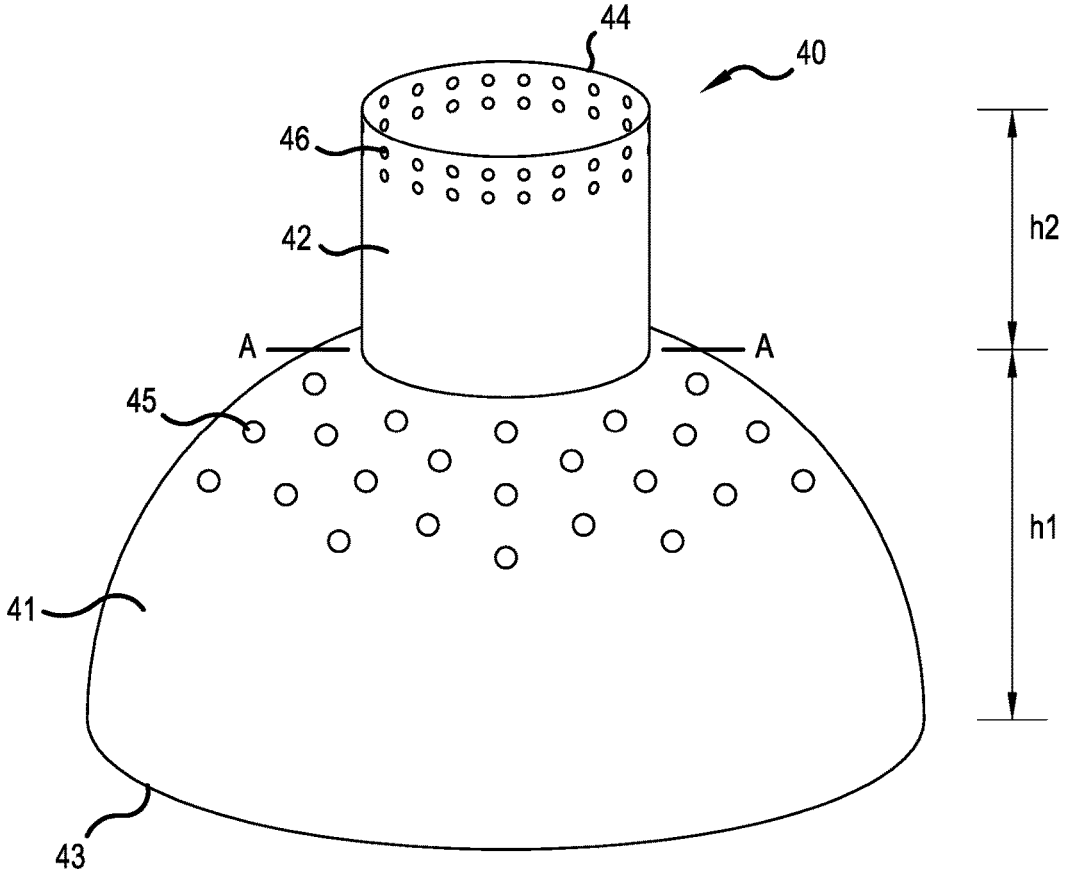
FIG. 2 is a perspective view of a separator shown in FIG. 1.

As shown in FIG. 2, the bowl section 41 includes first holes 45 formed on the upper half of the bowl section 41 with uniform distribution to allow the heat, gas and/or flame generated from the biomass during use pass through evenly. Some of the gas moves from a first chamber 60 (to be discussed later) to the second chamber 65 (to be discussed later) directly through the first holes 45 of the bowl section 41, and some of the gas 74 (to be discussed later) that does not directly pass through the first holes 45 flows along the spherical surface of the bowl section 41 and pass through another ones of the first holes 45. The chimney section 42 includes second holes 46 formed at a position adjacent to the upper end of the chimney section 42. The second holes 46 are provided on the upper end 44 of the chimney section 42 at even spacing to allow the heat, gas and/or generated by the biomass to be injected radially inwardly towards the center of the chimney section 42. A size of each first hole 45 is greater than a size of each second hole 46. The size of each first hole 45 may be approximately 0.25 inches, and the size of each second hole 46 may be approximately 3/16 inches. In addition, the number of the first holes 45 may be greater than the number of the second holes 46. For example, there may be 80 first holes and 50 second holes. The height h1 of the bowl section 41 may be approximately 5 inches, and the height h2 of the chimney section 42 may be approximately 5 inches. Moreover, a diameter of the chimney section 42 is constant from the upper end to the lower end of the chimney section 42 attached to the bowl section 41. However, the diameter of the upper end can be made slightly larger than the diameter of the lower end of the chimney section 42. For example, the upper and lower diameters of the chimney section 42 may be approximately 6.5 inches and 5.5 inches, respectively. This promotes the heat to escape from the gasification stove 10.

Figure 3:
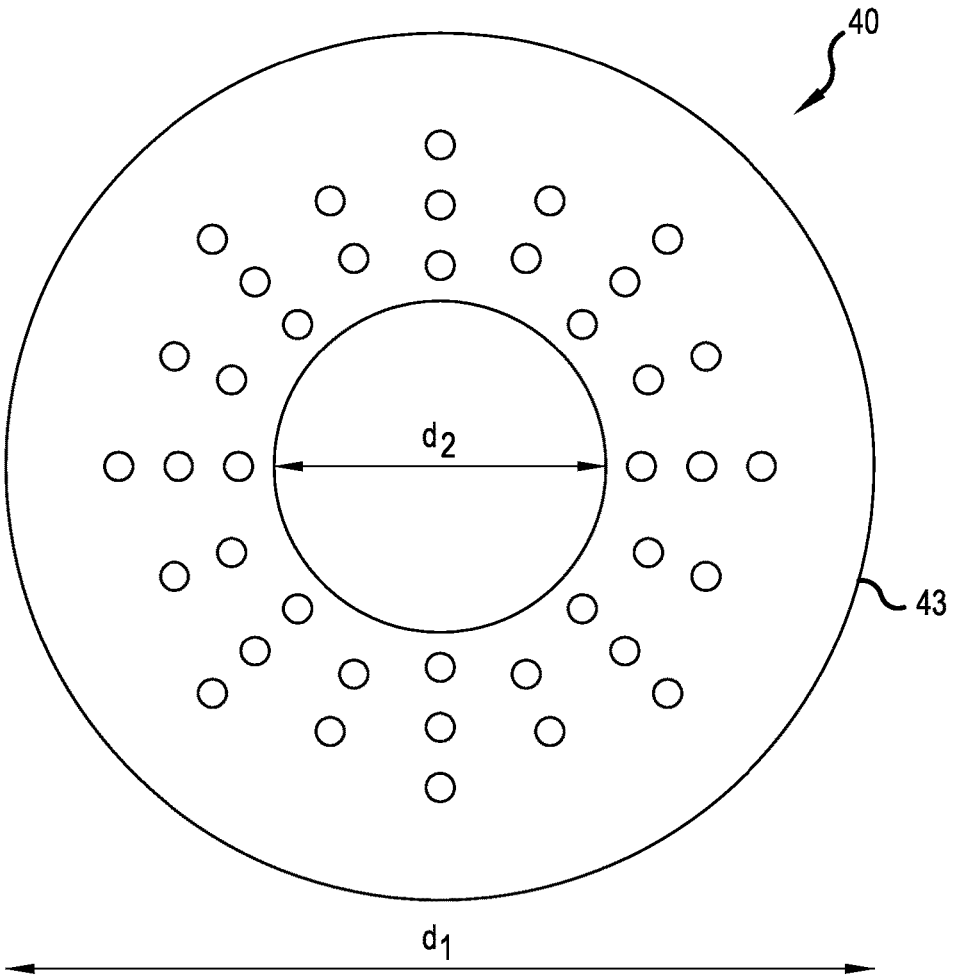
FIG. 3 is a view of the separator along the line AA shown in FIG. 2.

As shown in FIG. 3, as discussed above, the diameter d1 (e.g., 13 inches) of the lower end 43 of the bowl section 41 is approximately the same as the inner diameter of the upper housing 10 and/or the lower housing 20. A diameter d2 (e.g., 7 inches) of the lower end of the chimney section 42 is approximately 25-50% of the diameter dl of the lower end 43 the bowl section 41. Therefore, a radial distance from the lower end of the chimney section 42 to the lower end 43 of the bowl section 41 is approximately, 25-37.5% of the diameter dl of the lower end 43 the bowl section 41.

Assembly and use of the gasification stove 10 are explained below with reference to FIGS. 1 and 4.

First, the mesh 30 is inserted and placed in the lower housing 20. The mesh 30 is positioned between the first door 24 and the second door 26. Then, the separator 40 is placed at the upper end of the lower housing 20. Subsequently, the upper housing 10, which may optionally have the grill 50 in the vicinity of the opening 16 of the upper housing 10, is placed on the lower housing 20 so that the lower end of the upper housing 10 engages with the upper end of the lower housing 20. At this time, the upper end 44 of the chimney section 42 is positioned adjacent to, or slightly through, the opening 16 of the upper end. The upper end 44 of the chimney section 42 is then fixed to the opening 16 of the upper housing 10 by welding, adhesive, fastener or the like.

Figure 4:
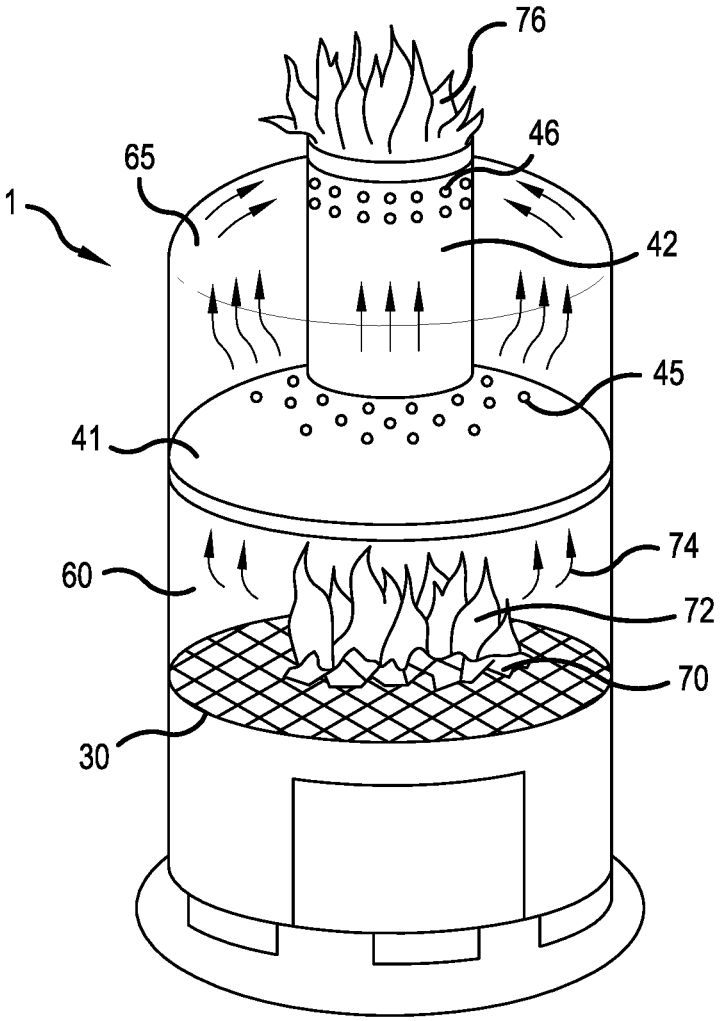
FIG. 4 is a diagram explaining operation of the gasification stove shown in FIG. 1.

At the assembly of the gasification stove 10, a first chamber 60 is formed by the mesh 30 and the inner surface of the bowl section 41 of the separator 40, and the second chamber 65 is formed by the inner surface of the upper housing 10, the outer surface of the bowl section 41 and the chimney section 42 of the separator 40, as shown in FIG. 4.

After assembly, biomass 70 is placed at the center of the mesh 30 through the first door 24. The biomass 70 may be wood, paper, grass, or any material that can combust. Here, wood is used as an example. The second door 26 is opened to allow oxygen to flow into the gasification stove 1. After lighting fire on the biomass 70, the first door 24 may be closed, while the second door 26 is kept open fully or may be half closed to control the oxygen level. When about 50% of the biomass 70 has combusted, the first door 24 is closed, and the opening of the second door 26 may be adjusted to control flow of oxygen inside the gasification stove 10. At this time, the biomass 70 continues generating a flame (primary combustion) 72 but starts combusting incompletely due to lack of oxygen inside the gasification stove 1. Incomplete combustion is a reaction or process which entails only partial combustion of a fuel. This may be due to a lack of oxygen or low temperature, preventing the complete chemical reaction. During this primary combustion, the biomass 70 generates gas 74, such as $H_2$, $CH_4$, $CO_2$, CO and $N_2$, and steam when the biomass 70 reaches about 150-200° C.

Because the chimney section 42 provides a large opening, which allows more flow of heat and smoke, the flame 72 in the first chamber 60 is directed to the chimney section 42 together with the flow of heat. On the other hand, the gas 74 generated from the biomass 70 first spreads diagonally and upwardly from the biomass 70 inside the first chamber 60 and raises upwardly as it is heated. About 90% of the gas 74 flows to the rounded inner surface of the bowl section 41. About 10% of the gas 74 flows towards the chimney section 42 but is pushed to the side due to the heat that flow to the chimney section 42. Therefore, most of the generated gas 74 is collected by the bowl section 41. Then, gas 74 rises along the inner surface of the bowl section 41 and flows from the first chamber 60 to the second chamber 65 through the first holes 45 provided on the upper half of the bowl section 41.

As more gas 74 is generated, and as the internal temperature of the gasification stove 1 increases, the internal pressure of the gasification stove 1 increases. This further prevents the flow of oxygen, which results in a lower combustion speed of the biomass 70.

The gas 74 that flows into the second chamber 65 then flows to the upper section of the second chamber 65. Because the upper end of the upper housing 10 is made in a dome shape, the gas 74 at the upper end of the upper housing 10 (i.e. the upper end of the second chamber 65), is compressed, thereby air pressure at the upper end of the second chamber 65 increases. In addition, the dome shape of the upper end of the upper housing 10 also helps the compressed gas 74 to be directed towards the second holes 46 such that the compressed gas 74 flows through the second holes 46 provided at the upper end of the chimney section 42 radially inwardly into the body of the chimney section 42. The gas 74 that has flown through the second holes 46 is exposed to the heat from the first chamber 60 through the chimney section 42. When the heat from the first chamber 60 reaches a certain temperature, $H_2$ starts combusting. Other gases, which absorb heat, start generating heat at this temperature range, thereby increasing the temperature rapidly. As the temperature increases, some of carbon starts combusting. In addition, carbohydrate formed by combusted carbon starts combusting. As a result, additional flame (secondary combustion) 76 is caused at the upper end of the housing 1, and most of the carbon (including $CO_2$) combusts at the secondary combustion. This means that the gasification stove according to the present application not only efficiently combusts the biomass but also generate less amount of environmentally harmful gas.

Despite the incomplete combustion of the biomass 70 in the first chamber 60, because of the secondary combustion 76 generated at the upper end of the chimney section 42, the gasification stove 1 according to the present application can generate three times as much fire power as the conventional gasification stove. Also, because the gasification stove 1 according to the present application can generate more fire power, the gasification stove 1 uses less biomass to generate the same fire power as the conventional gasification stove.

Figure 5:
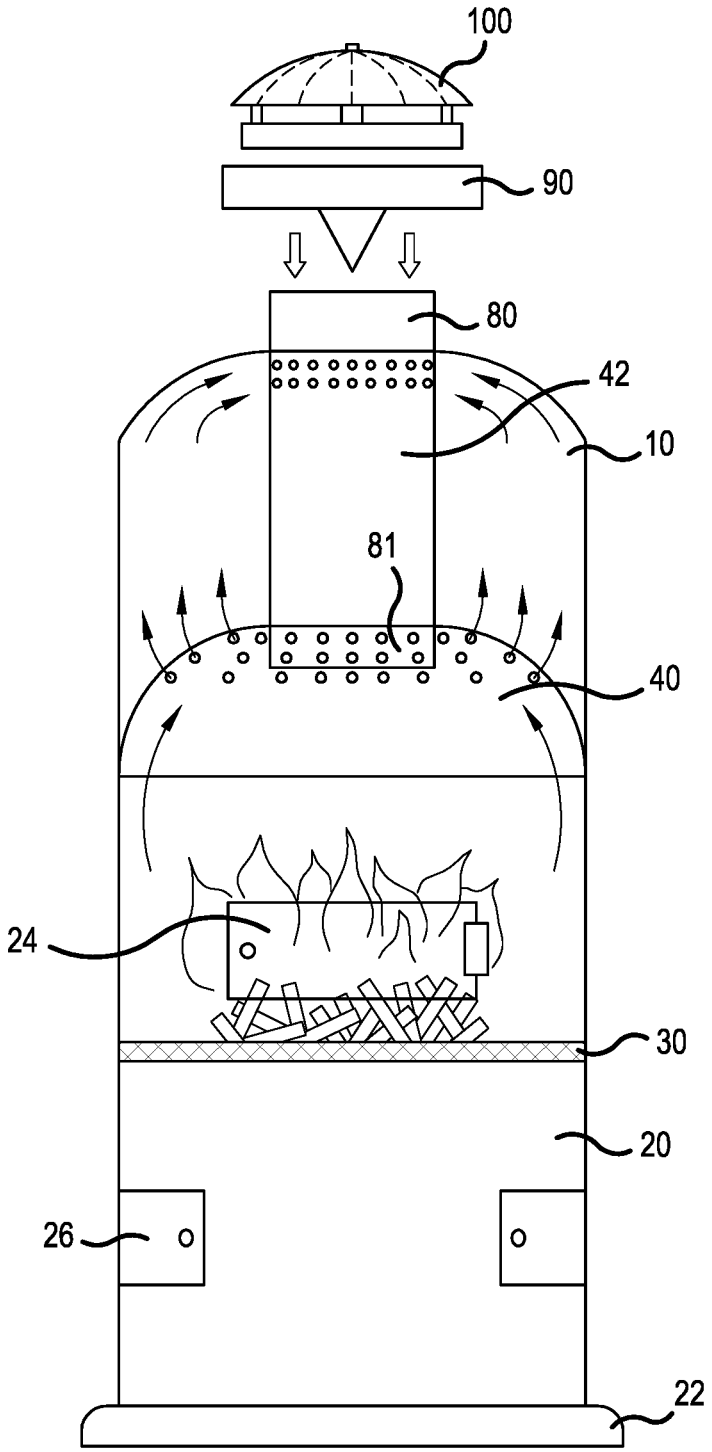
FIG. 5 is an exploded view of a gasification stove according to a second embodiment of the present application.

According to a second embodiment of the present application shown in FIG. 5, the gasification stove 1 has the following additional features.

In the second embodiment, there may be two second doors 24 on the lower housing 20 that are arranged on the opposite side of the lower housing 20 for intake of additional oxygen.

In addition, the length of the chimney section 42 may be increased to extend above the opening 16 of the upper housing 10 by approximately 2.5 inches and below the upper end of the separator 40 by approximately 1.5 inches. The upper extension 80 of the chimney section 42 above the opening 16 provides a support for holding the later-discussed water tub ring 90. This upper extension 80 may be an integral part of the chimney section 42 or an additional extension parts that can be attached to the chimney section 42 of the first embodiment.

Figure 6:
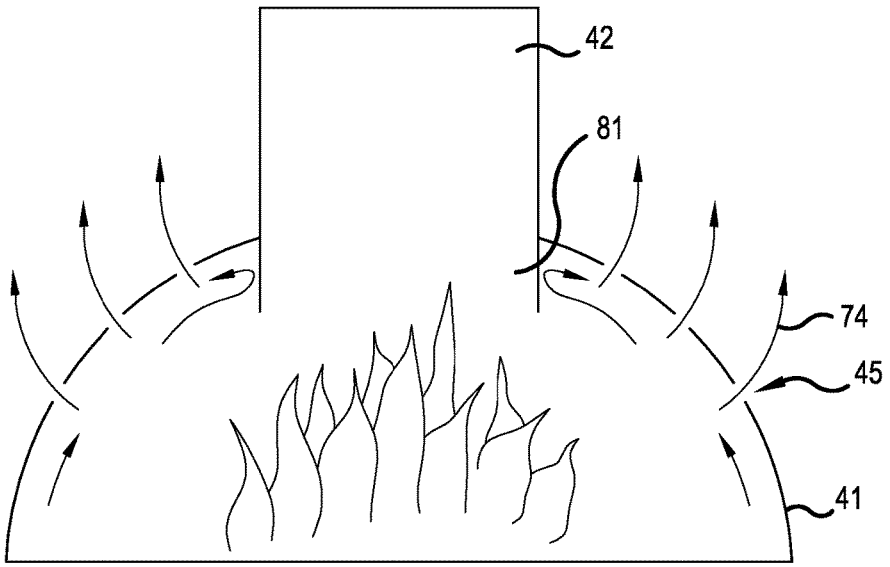
FIG. 6 is a cross-sectional view of a semispherical bowl section according to the second embodiment of the present application.

The lower extension 81 below the upper end of the separator 40 provides the following effect. As shown in FIG. 6, the gas 74 rises from the burned biomass. As discussed earlier, some of the gas 74 moves from the first chamber 60 to the second chamber 65 directly through the first holes 45 of the bowl section 41, and some of the gas 74 that does not directly pass through the first holes 45 flows along the spherical surface of the bowl section 41 and pass through another ones of the first holes 45. The lower extension 81 functions as a wall to prevent the gas 74 from escaping from the lower opening of the chimney section 42. This provides additional 5-10% of the gas 74 to move to the second chamber 65. As a result, approximately 95% (or more) of the gases generated from burning biomass are collected and transferred to the second chamber 65 through the openings 45. Therefore, less smoke is released into the atmosphere from the chimney section 42. This additional gas into the second chamber 65 also helps increase the air pressure inside the second chamber 65 even more, which further pushes the existing gas to the upper section of the second chamber 65 and then into the chimney section 44 via the second holes 46. The length of the lower extension 81 may be approximately 1.5 inches in the second embodiment. However, it is apparent that the length of the lower extension 81 may be determined depending on the size of the gasification stove 1 and the amount of the gas 74 expected to be generated so that the gas 74 is effectively and fully stopped.

Figure 7A:
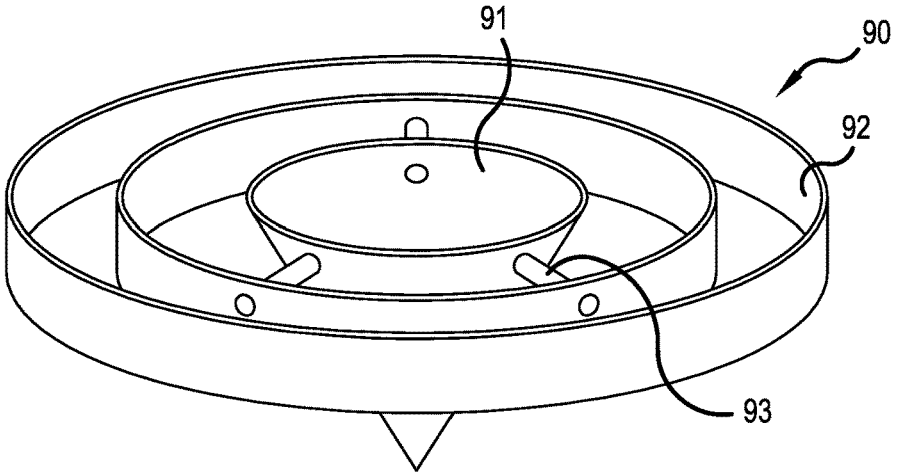
FIG. 7A is a perspective view of a water tub ring according to the second embodiment according to the present application.
Figure 7B:
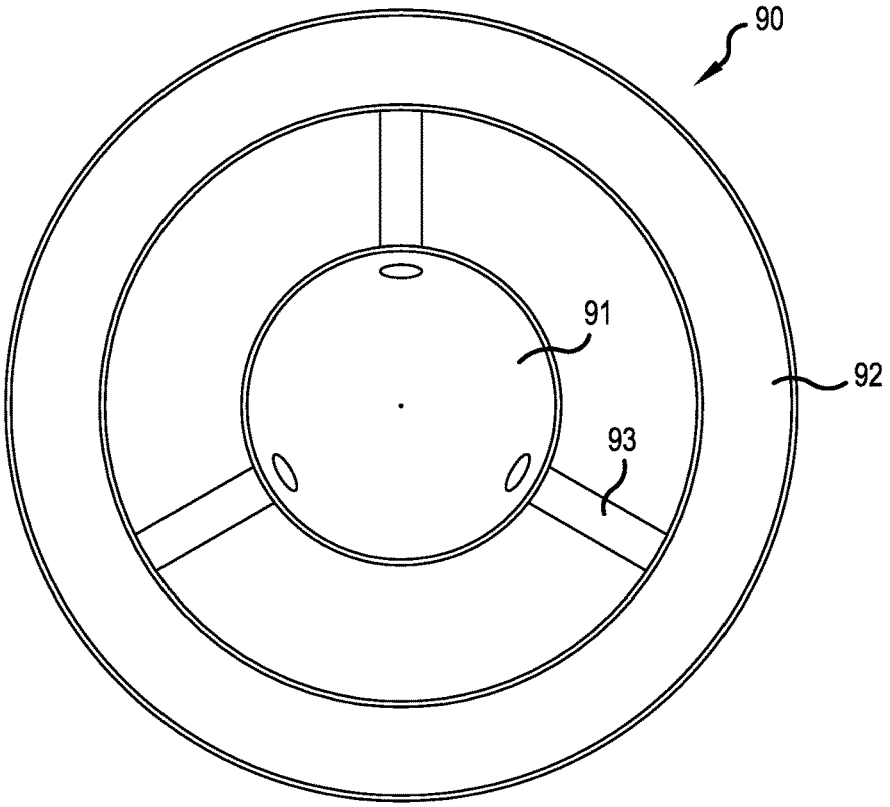
FIG. 7B is a top view of the water tub ring.

According to the second embodiment, an optional water tub ring 90 may be removably or fixedly provided on the upper extension 80 of the chimney section 42. The water tub ring 90 is made of a heat resistant material, such as iron, and is formed by an inner tub 91 and an outer tub 92 connected by a number of pipes 93 as shown in FIGS. 7A and 7B.

The inner tub 91 has an inverted conical shape such that the vertex faces downwardly inside the chimney section 42. The inner tub 91 holds liquid such as water. The outer tub 92 is in a ring shape and has a predetermined depth to hold the liquid. The inner tub 91 has a greater depth than the outer tub 92 as shown in FIG. 5. Generally, the temperature of the liquid in the inner tub 91 increases faster than the liquid in the outer tub 92 because the surface area of the inner tub 91 that contact the flame/heat inside the chimney section 42 is greater. However, because the inner tub 91 and the outer tub 92 are connected by the number of pipes 93, the liquid in the inner tub 91 and the outer tub 92 communicates so that the liquid temperature in the inner tub 91 and the outer tub 92 are equalized and that the liquid level in the inner tub 91 and the outer tub 92 is maintained about the same. The diameter of the pipes 93 may be 0.5 inches and 1.5 inches in length.

When the liquid in the inner tub 91 and the outer tub 92 boils, the steam forms a steam chimney. This prevents the smoke from the chimney section 42 from spreading widely after being exited from the chimney section 42 so that the smoke continues traveling upwardly. In addition, the vapored water absorbs the smoke. Therefore, the gasification stove produces much less smoke than the conventional gasification stove.

Figure 9:
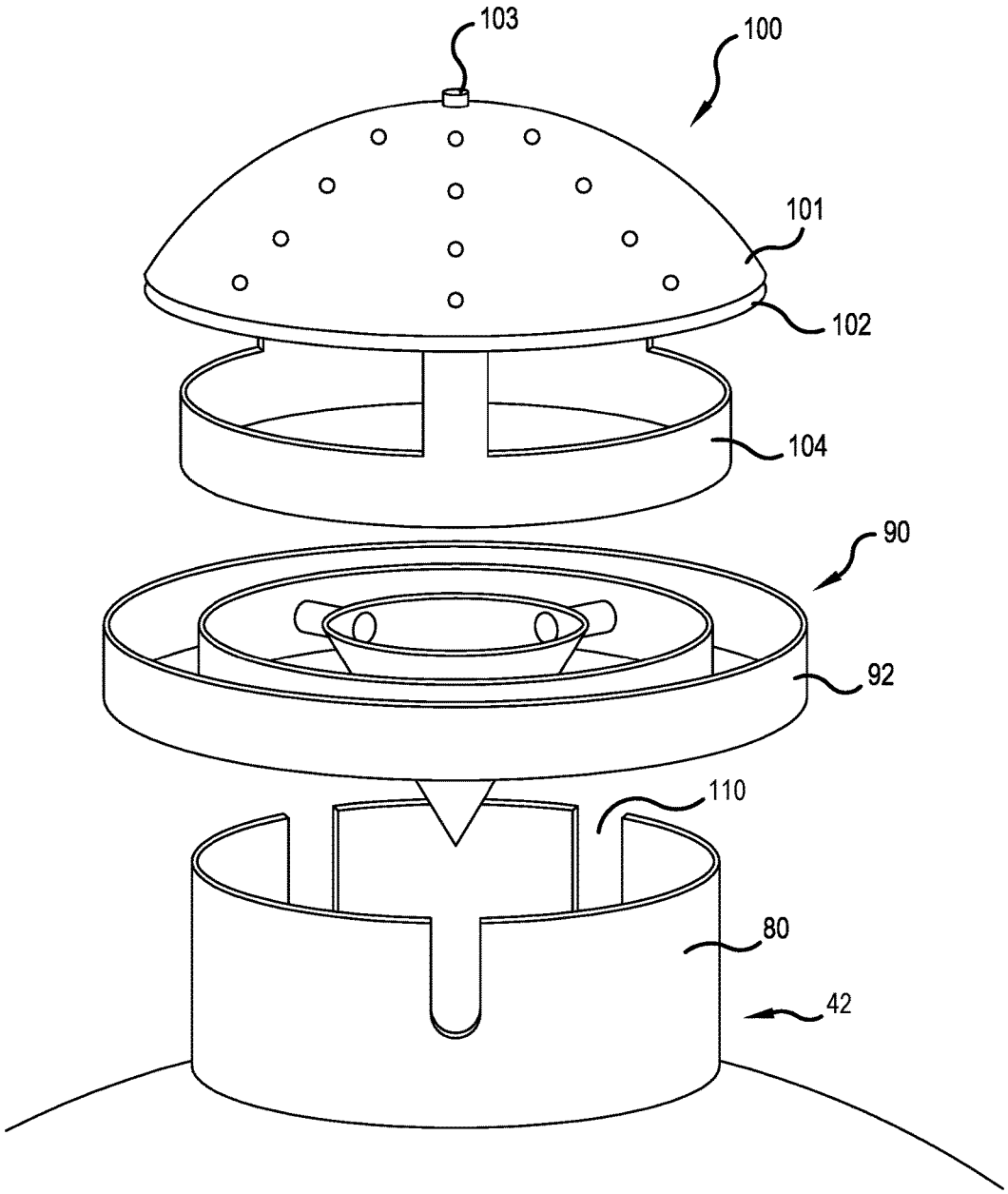
FIG. 9 is an exploded view of a section of a gasification stove according to another embodiment.

The size of the inner tub 91 and the outer tub 92 may be arbitrary as long as there is a sufficient amount of space between the inner tub 91 and the outer tub 92 to allow the flame and the heat to pass through. For instance, the diameter of the inner tub 91 may be approximately 4.75 inches, and the depth of the inner tub 91 may be approximately 6.25 inches. The inner and outer diameters of the outer tub 92 may be 7 inches and 11.25 inches, respectively, and the depth may be approximately 2 inches. The inner diameter of the outer tub 92 may be slightly larger than the diameter of the chimney section 42 so that upper extension 80 of the chimney section 42 fits inside the inner diameter of the outer tub 92 and receives the water tub ring 90 as the pipes 93 abut the upper extension 80 of the chimney section 42. For better placement, as shown in FIG. 9, slits 110 may be provided on the upper extension 80 of the chimney section 42, and the pipes 93 may be inserted into the slits 110. The outer tub 92 may also be directly placed on the upper end 14 of the upper housing 10 when there is no upper extension 80 as in the first embodiment.

Figure 8:
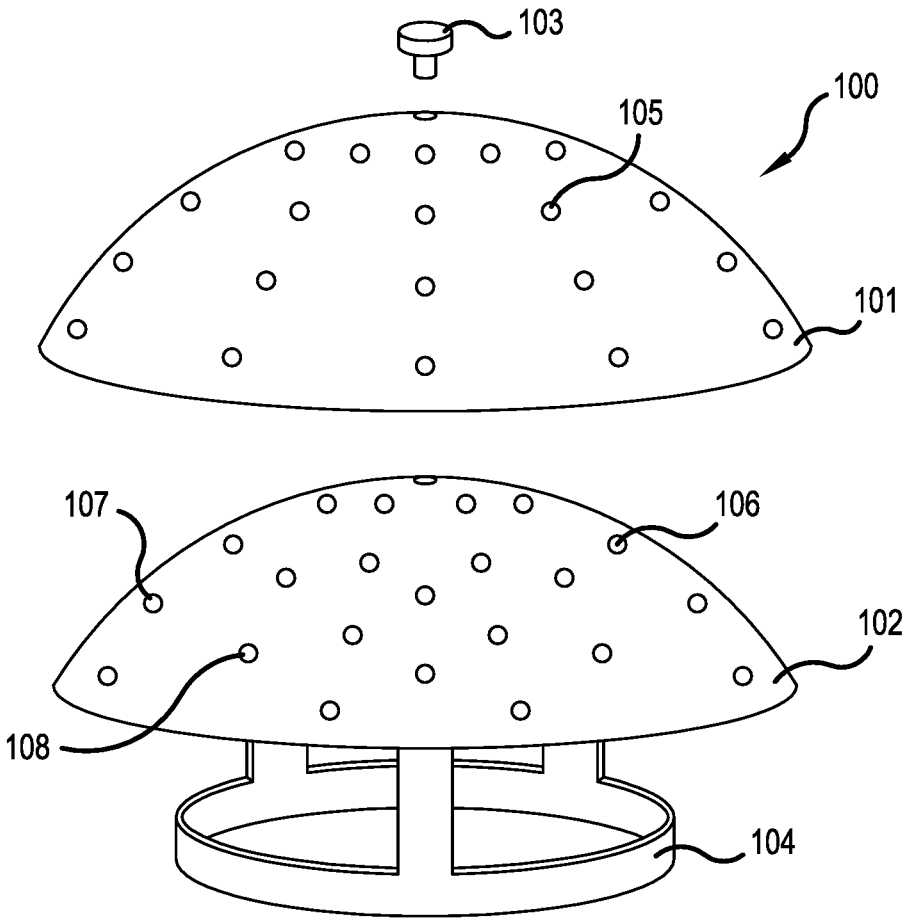
FIG. 8 is an exploded view of a cap according to the second embodiment according to the present application.

Above the water tub ring 90, an optional cap 100 may be provided for controlling the heat as shown in FIG. 5. The cap 100 may have a diameter of approximately 9 inches. As shown in FIG. 8, the cap 100 is formed by an upper cap 101 and a lower cap 102 rotatably attached by a fastener 103. The lower cap 102 has a circular base 104. The base 104 may have a diameter of approximately 7 inches and a height of approximately 2.5 inches. The total cap height may be approximately 4 inches, where the height of the cap itself may be approximately 2 inches, and the base height may be approximately 2 inches. As shown in FIG. 9, the diameter of the base 104 may be slightly larger than the diameter of the upper extension 80 of the chimney section 42 so that, similar to the water tub ring 90, the upper extension 80 of the chimney section 43 can be inserted through the base 104, and the base 104 can be placed on the inner diameter of the outer tub 92.

The upper cap 101 has a first pattern of holes 105, in which a predetermined number of holes (e.g., four holes) are aligned in a radial direction of the upper cap 101, and there is a predetermined number of the radially aligned holes that are arranged in a circumferential direction of the upper cap 101. The lower cap 102 has a second pattern of holes 106, in which a predetermined number of holes (e.g., four holes) are similarly aligned in a radial direction of the lower cap 102 forming a first group of holes 107, and there is a predetermined number of the first groups of holes 107 that are arranged in a circumferential direction of the lower cap 102. In addition, there is a predetermined number of holes (e.g., two holes) aligned in the radial direction of the lower cap 102 forming the second group of holes 108. The first groups of holes 107 and the second groups of holes 108 are formed alternately. Therefore, by rotating the upper cap 101, the user can align the holes 105 with the first groups of holes 107 or the second groups of holes 108 to adjust the amount of heat to pass through the holes 105 and 107/108. The first pattern of holes 105 may be provided on the lower cap 102, and the second pattern of holes 106 may be provided on the upper cap 101. Those skilled in the art would appreciate that formation shape of the holes of the first and second patterns and the number and size of the holes of the first and second patterns can be determined as needed in the use environment of the gasification stove 1.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of examples only, and various other modifications will be apparent to persons skilled in the field without departing from the scope of the invention as defined by the appended claims.

For example, the amount of space for the first chamber and the second chamber may be changed based on the amount and the biomass used and/or the amount of fire power needed for use. Depending on the amount of space for the first chamber and/or the second chamber, the size of the gasification stove may vary. Moreover, the shape of the gasification stove may not be cylindrical but in any shape that achieve the effect of the present application.

The invention claimed is:

1. A gasification stove for burning biomass, comprising:

an upper housing including an upper hollow body with a first opening and a dome section having a chimney opening;

a lower housing including a lower hollow body with a closed bottom and a second opening that is connectable to the first opening of the upper hollow body, the upper housing and the lower housing forming a stove chamber when connected to each other;

a separator for collecting a gas and flame generated from burning of the biomass, the separator being arranged in the stove chamber and including a bowl section and a chimney section, the bowl section having a first set of holes formed in an upper part thereof, a lower edge of the bowl section having a diameter approximately equal to a diameter of the stove chamber, a lower part of the chimney section being connected to the upper part of the bowl section, an upper part of the chimney section having a second set of holes, the upper part of the chimney section being air-tightly attached to an edge of the chimney opening of the upper housing, wherein at least some of the gas flows through the first set of holes and the second set of holes to enter into the chimney section at the upper part of the chimney section so as to react with the flame or hot air in the chimney section to generate additional flame power.

2. The gasification stove according to claim 1, wherein a diameter of the chimney section increases from the lower part to the upper part thereof.

3. The gasification stove according to claim 1, wherein a diameter of the lower part of the chimney section is approximately 25-50% of the diameter of the lower part of the bowl section.

4. The gasification stove according to claim 1, wherein the lower housing further includes a first window, a second window, and a mesh as a stage for burning the biomass, and the mesh is positioned between the first window and the second window.

5. The gasification stove according to claim 1, wherein the chimney section includes an upper extension that projects outwardly from the chimney opening of the upper housing, and the gasification stove further comprising a water tub ring to be placed on an upper edge or an outer circumferential surface of the upper extension of the chimney section, the water tub ring including an inner tub and an outer tub concentrically arranged with and connected to the inner tub by a predetermined number of pipes to allow liquid contained in the inner tub and the outer tub to flow between the inner tub and the outer tub.

6. The gasification stove according to claim 5, wherein the outer tub has a diameter slightly larger than a diameter of the upper extension of the chimney section.

7. The gasification stove according to claim 5, wherein the upper extension of the chimney section includes a predetermined number of slots for supporting the predetermined number of pipes, and the predetermined number of slots are arranged on the upper extension of the chimney section at a position corresponding to the predetermined number of pipes.

8. The gasification stove according to claim 5, wherein the inner tub has a depth greater than a depth of the outer tub.

9. The gasification stove according to claim 5, wherein the inner tub has an inverted conical shape.

10. The gasification stove according to claim 1, wherein the chimney section includes a lower extension that protrudes downwardly from the upper part of the bowl section and that functions as a gas stoppage wall that stops the gas that flows along an inner surface of the bowl section.

11. The gasification stove according to claim 1, further comprising a cap that is positioned on an upper edge of the chimney section.

12. The gasification stove according to claim 11, wherein the cap includes:

a lower cap having a first pattern of holes, and a base attached to the lower cap, and the base of the cap is attached to one of the upper edge or an outer circumference surface of the chimney section.

13. The gasification stove according to claim 12, wherein the cap further includes an upper cap rotatably attached to the lower cap and having a second pattern of holes.

* * * * *